US011109649B2

(12) United States Patent
Matsui et al.

(10) Patent No.: US 11,109,649 B2
(45) Date of Patent: Sep. 7, 2021

(54) FASTENER

(71) Applicant: YKK Corporation, Tokyo (JP)

(72) Inventors: Takayuki Matsui, Kurobe (JP); Zhiyu Ren, Kurobe (JP); Atsushi Nakaya, Macon, GA (US); Kazuhiro Nozaka, Macon, GA (US); Tetsuya Yoshino, Novi, MI (US); Ayumi Fujisaki, Macon, GA (US); Nao Yasuda, Kurobe (JP); Masayoshi Kinoshita, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/849,408

(22) Filed: Apr. 15, 2020

(65) Prior Publication Data

US 2020/0329826 A1 Oct. 22, 2020

Related U.S. Application Data

(60) Provisional application No. 62/835,111, filed on Apr. 17, 2019.

(51) Int. Cl.
*A44B 18/00* (2006.01)

(52) U.S. Cl.
CPC ..... *A44B 18/0015* (2013.01); *A44D 2203/00* (2013.01)

(58) Field of Classification Search
CPC . A44D 2203/00; Y10T 24/32; A44B 18/0015; A44B 18/0053
See application file for complete search history.

(56) References Cited

U.S. PATENT DOCUMENTS

| | | | | |
|---|---|---|---|---|
| 6,463,635 | B2 | 10/2002 | Murasaki | |
| 6,720,059 | B2 * | 4/2004 | Fujisawa | B32B 5/18 428/100 |
| 8,756,770 | B2 | 6/2014 | Cina et al. | |
| 9,034,452 | B2 | 5/2015 | Cina et al. | |
| 9,138,032 | B1 | 9/2015 | Cina et al. | |

(Continued)

FOREIGN PATENT DOCUMENTS

| | | | |
|---|---|---|---|
| JP | 2017-023724 | A | 2/2017 |
| WO | 2016/002044 | A1 | 1/2016 |
| WO | 2016/002049 | A1 | 1/2016 |

OTHER PUBLICATIONS

Office Action, Japanese Patent Application No. 2020-036613, dated Mar. 30, 2021, 5 pages.

*Primary Examiner* — Robert Sandy
(74) *Attorney, Agent, or Firm* — Kilpatrick Townsend & Stockton LLP

(57) ABSTRACT

There is provided a fastening tape. A plurality of fastening cells on a surface of an elongated substrate. Each of at least some of the fastening cells includes: a fastening element array; one or more barriers at least partially surrounding the fastening element array; at least one slit provided in an upper portion of at least one of the one or more barriers; and a fastening element at least partially filling the slit. At least some of the fastening cells which are adjacent to each other in a longitudinal direction are separated from each other by an open space extending across the substrate in a lateral direction. The fastening element extends inward of the respective fastening cells in a direction away from a respective one of the open spaces.

7 Claims, 11 Drawing Sheets

(56) References Cited

U.S. PATENT DOCUMENTS

| | | | |
|---|---|---|---|
| 9,504,296 | B2 | 11/2016 | Cina et al. |
| 9,635,910 | B2 | 5/2017 | Cina et al. |
| 9,826,801 | B2 | 11/2017 | Mascarenhas et al. |
| 9,918,526 | B2 | 3/2018 | Mascarenhas et al. |
| 10,258,113 | B2 | 4/2019 | Imai et al. |
| 10,327,518 | B2 | 6/2019 | Imai et al. |
| 10,524,547 | B2 | 1/2020 | Okuda et al. |
| 10,548,374 | B2 * | 2/2020 | Ren ..... A44B 18/0049 |
| 2005/0160534 | A1 | 7/2005 | Akeno et al. |
| 2017/0013918 | A1 | 1/2017 | Nakaya et al. |
| 2017/0013919 | A1 | 1/2017 | Ren et al. |
| 2017/0119107 | A1 | 5/2017 | Okuda et al. |
| 2017/0150788 | A1 | 6/2017 | Imai et al. |
| 2020/0121034 | A1 | 4/2020 | Ren et al. |

* cited by examiner

FASTENER

REFERENCE TO RELATED APPLICATIONS

This application claims the benefit of U.S. Provisional Application No. 62/835,111, filed Apr. 17, 2019 and entitled FASTENING TAPE, the content of which is hereby incorporated by reference in its entirety.

TECHNICAL FIELD

The present disclosure relates to a fastening tape configured to fasten a cover material for covering a surface of a vehicle seat, a chair, or the like.

BACKGROUND

A vehicle seat or a chair may include a cushion material or a soft pad that is covered by a cover material. So far, a variety of structures have been employed to fix the cover material to the cushion while concealing a structural exterior thereof. One of such structures is a fastening tape, which has an array of engaging elements (hook fasteners or male fasteners) embedded in the cushion and configured to engage with loop fasteners attached to a back surface of the cover material. To embed the fastening tape into the cushion, the fastening tape is set on a trench within a mold for molding the cushion. During the molding process, the fastening tape is placed on the trench with the engaging elements facing down toward a surface of the trench. Subsequently, expandable foam is introduced into the mold having the fastening tape embedded therein. After the foam has been expanded, cured and then removed from the mold, the fastening tape is integrally embedded in the cushion with the engaging elements exposed to the outside.

During this expansion molding, it is often important to minimize intrusion of foam into the region of engaging elements, thereby minimizing fouling of foam on the engaging elements, which may negatively impact on engagement strength of the fastening tape with the loop fasteners. Particularly, if the trench surface, on which the fastening tape is positioned, is curved instead of planar, foam intrusion is more prone to occur. Thus, the fastening tape needs to conform to the shape of the trench surface, on which the fastening tape is placed, including rounded or curved surfaces. In addition, it is often important for the fastening tape to be securely attached to the cushion to resist various peeling forces or other forces, which may undesirably cause the fastening tape to separate from the cushion.

SUMMARY (1) A fastening tape, comprising: an elongated substrate; and a plurality of fastening cells on a surface of the substrate, wherein each of at least some of the fastening cells comprises: a fastening element array; one or more barriers at least partially surrounding the fastening element array; at least one slit provided in an upper portion of at least one of the one or more barriers; and a fastening element at least partially filling the slit, wherein at least some of the fastening cells which are adjacent to each other in a longitudinal direction are separated from each other by an open space extending across the substrate in a lateral direction, wherein the fastening element at least partially filling the slit extends inward of the respective fastening cells in a direction away from a respective one of the open spaces.

(2) A fastening tape, comprising: an elongated substrate; a plurality of fastening cells on a surface of the substrate; and a magnetic material in at least one linear arrangement along a longitudinal direction of the substrate, wherein each of at least some of the fastening cells comprises: a fastening element array; and one or more barriers at least partially surrounding the fastening element array; wherein the magnetic material has a plurality of breaks formed at a predetermined interval in the longitudinal direction, wherein at least some of the fastening cells which are adjacent to each other in the longitudinal direction are separated from each other by an open space extending across the substrate in a lateral direction, wherein at least some of the plurality of breaks of the magnetic material are arranged to be aligned with the open spaces in the lateral direction, wherein a width of the open spaces in the longitudinal direction is set to be equal to a width of the at least some of the plurality of breaks of the magnetic material in the longitudinal direction.

(3) The fastening tape according to (1), wherein the one or more barriers are a pair of longitudinal walls extending in the longitudinal direction and a pair of lateral walls extending in the lateral direction between the pair of longitudinal walls, and wherein the at least one slit is provided in an upper portion of the pair of lateral walls.

(4) The fastening tape according to (2), wherein the one or more barriers are a pair of longitudinal walls extending in the longitudinal direction and a pair of lateral walls extending in the lateral direction between the pair of longitudinal walls, wherein each of the pair of longitudinal walls has a plurality of interrupted regions formed at a predetermined interval in the longitudinal direction, and wherein the interrupted regions of the longitudinal walls are arranged to be aligned with the open spaces in the lateral direction.

(5) The fastening tape according to (4), wherein the magnetic material is a pair of magnetic walls arranged adjacent to the pair of longitudinal walls, respectively, inward in the lateral direction from the pair of longitudinal walls.

(6) The fastening tape according to (4), wherein at least one of the magnetic material and the longitudinal walls has a protrusion.

(7) The fastening tape according to (5), wherein a width of the interrupted regions of the longitudinal walls in the longitudinal direction is set to be smaller than a width of the breaks of the magnetic material in the longitudinal direction.

DETAILED DESCRIPTION

Hereinafter, embodiments of a fastening tape according to the present disclosure will be described in detail on the basis of the accompanying drawings. Also, the embodiments of the fastening tape will be described based on a longitudinal direction and a lateral direction perpendicular to each other. Meanwhile, in the following description, an upper side (upward direction) refers to a front side with the paper surface of FIG. 2, and a lower side (downward direction) refers to a back side with respect to the paper surface of FIG. 2. The longitudinal direction is a direction along a length direction of the fastening tape (right and left direction in FIG. 2). The lateral direction is a direction perpendicular to the upward and downward direction and the longitudinal direction (upward and downward direction in FIG. 2).

First Embodiment

First, a first embodiment of a fastening tape according to the present disclosure will be described with reference to FIGS. 1 to 7.

Figure 1:
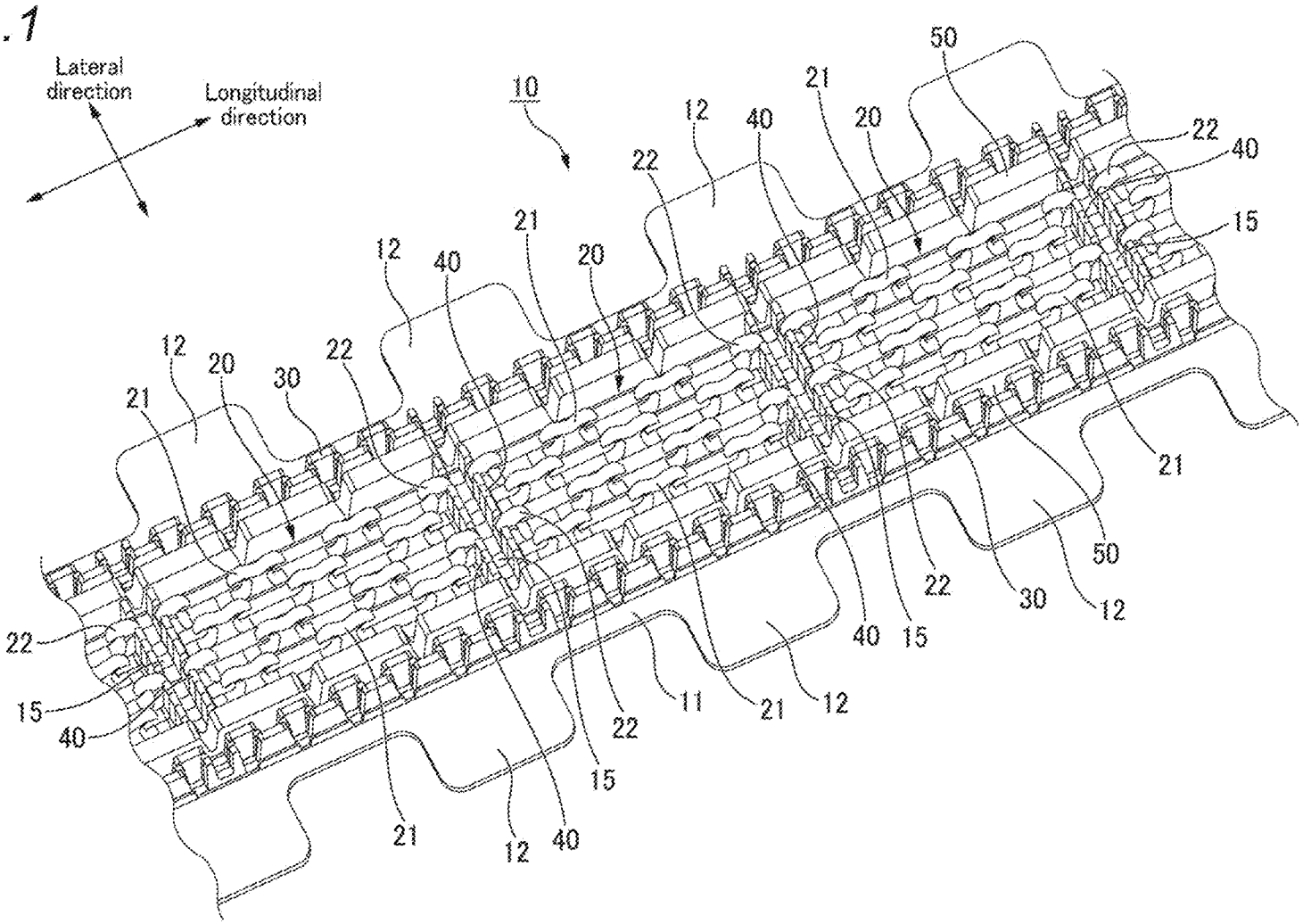
FIG. 1 is a top perspective view showing a first embodiment of a fastening tape according to the present disclosure.
Figure 2:
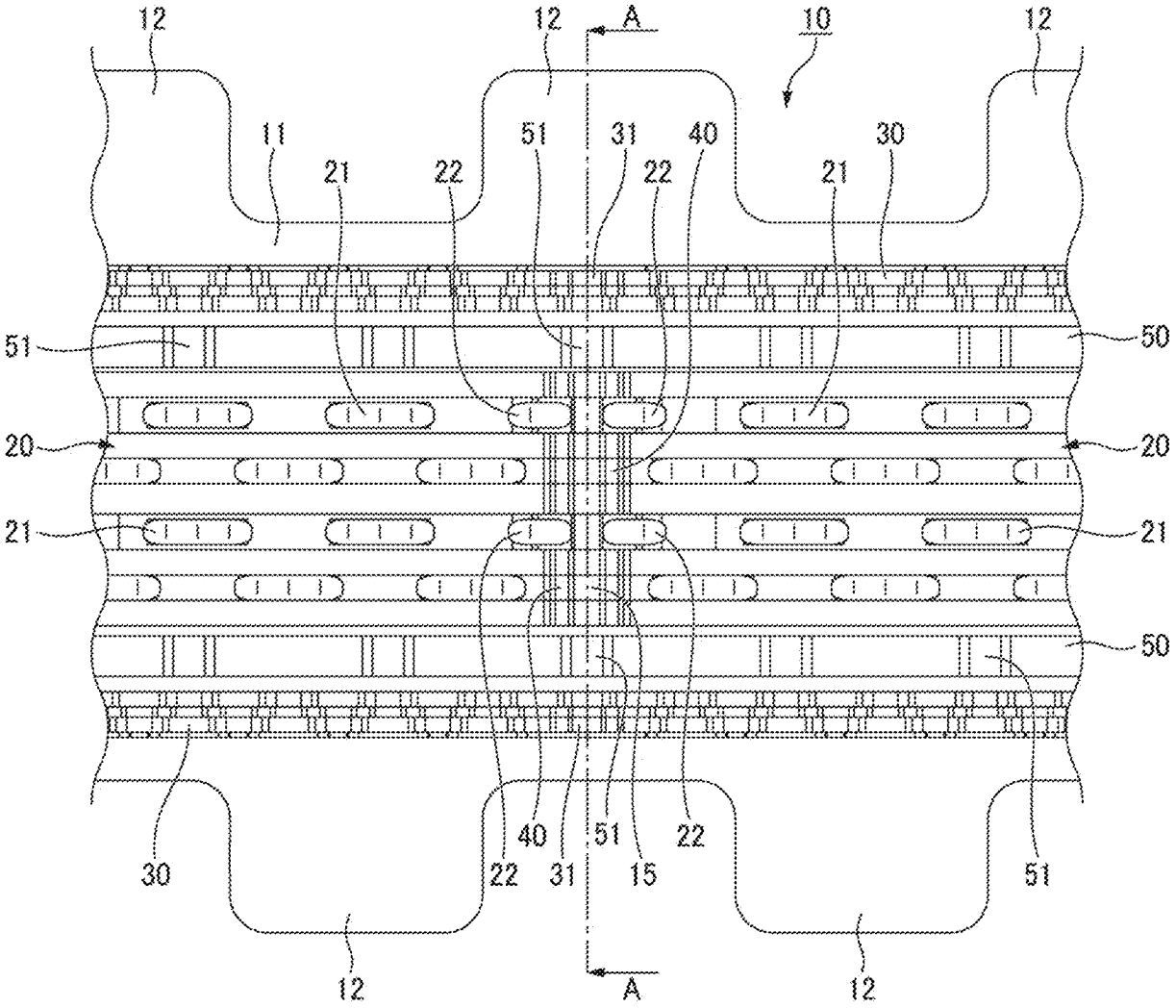
FIG. 2 is a top view of the fastening tape shown in FIG. 1.
Figure 3:
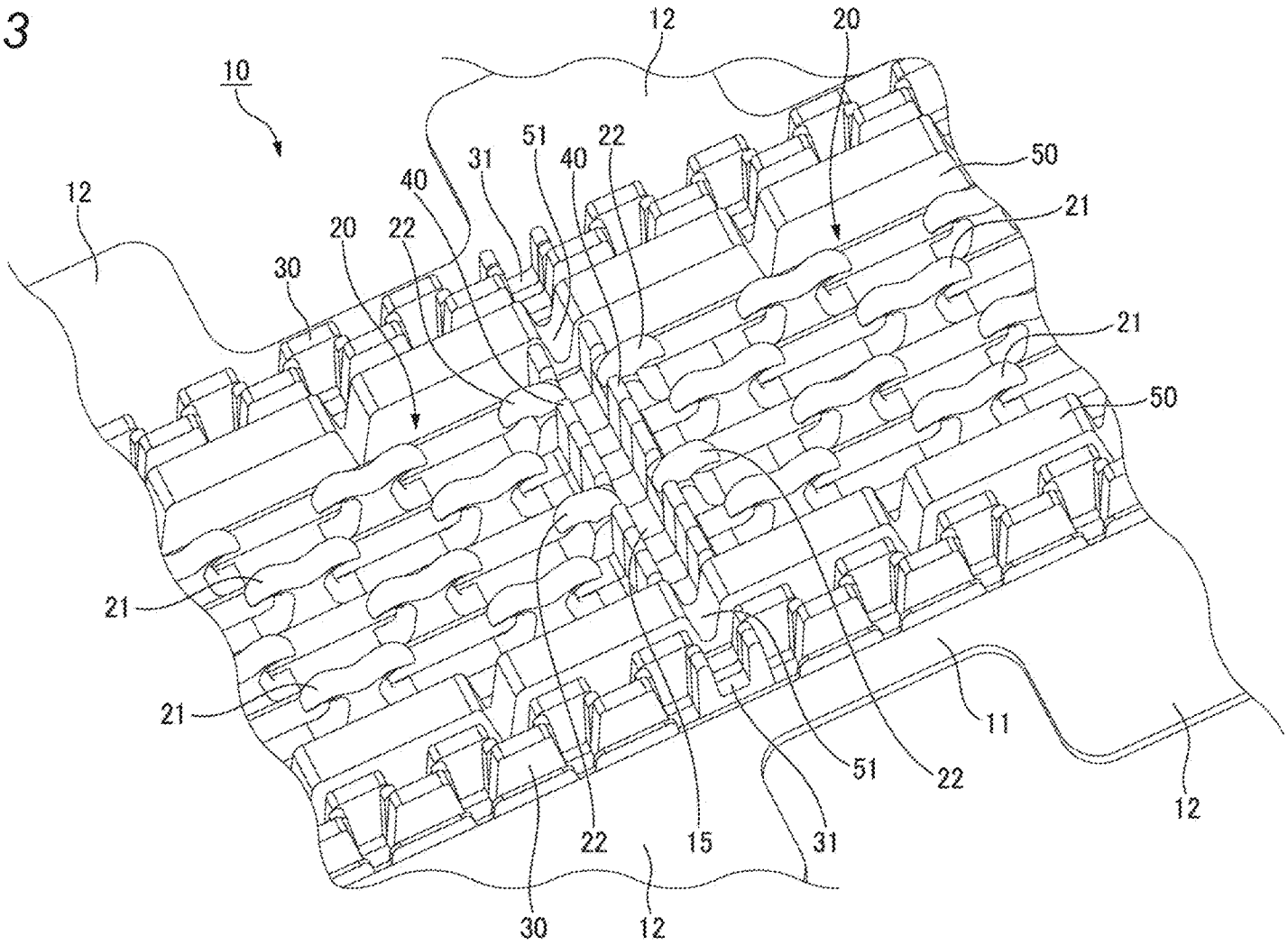
FIG. 3 is an enlarged perspective view of the vicinity of adjacent fastening cells shown in FIG. 1.

As shown in FIGS. 1 to 3, the fastening tape 10 according to the present embodiment includes an elongated substrate 11; an array of engaging elements (fastening elements) 21 formed on an upper surface of the substrate 11; a pair of longitudinal walls 30 extending in the longitudinal direction near respective lateral side ends of the substrate 11; and a pair of lateral walls 40 extending in the lateral direction between the pair of longitudinal walls 30. The longitudinal walls 30 and the lateral walls 40 are formed on the upper surface of the substrate 11. Also, the substrate 11 of the present embodiment has a plurality of flanges 12 extending outward in the lateral direction from the lateral side ends of the substrate 11.

In the present embodiment, a plurality of engaging elements 21 are surrounded by the pair of longitudinal walls 30 and the pair of the lateral walls 40, thereby forming a fastening cell 20. The longitudinal walls 30 and the lateral walls 40 are barriers for preventing foam from intruding into the fastening cell 20 during a molding process for a cushion. Each of the pair of longitudinal walls 30 defining the fastening cell 20 continuously extends in the longitudinal direction within a range, in which the fastening cell 20 is formed. In the shown example, each of the pair of longitudinal walls 30 is a zigzag wall, in which a plurality of longitudinal wall pieces is arranged in a zigzag fashion along the longitudinal direction. Alternatively, each of the longitudinal walls 30 may be configured as a single wall continuously extending in the longitudinal direction. A plurality of fastening cells 20 are formed along the longitudinal direction on the upper surface of the substrate 11. Also, an open space 15, in which no engaging elements 21 are formed on the substrate 11, is formed between the fastening cells 20 adjacent to each other in the longitudinal direction. In other words, at least some of the fastening cells 20 are separated from each other by open spaces 15 extending across the substrate 11 in the lateral direction.

Each of the longitudinal walls 30 has a plurality of interrupted regions 31 formed at a predetermined interval in the longitudinal direction. The interrupted regions 31 are regions, at which the longitudinal wall 30 is interrupted on its way, more specifically, regions, at where the longitudinal wall 30 is not formed, or regions, at which the longitudinal wall 30 is formed to have a height lower than at the other locations on the longitudinal wall 30. Further, the interrupted regions 31 allow foam to be introduced into the open spaces 15 in the lateral direction during the molding process for the cushion. However, it should be noted that the configuration of the interrupted regions 31 is not limited to the above configuration.

The interrupted regions 31 of the longitudinal walls 30 are arranged to be aligned with the respective open spaces 15 in the lateral direction, so that the respective open spaces 15 extend in the lateral direction therethrough. Thus, the interrupted regions 31 of the longitudinal walls 30 can become a part of the respective open spaces 15. Therefore, during the molding process for the cushion, foam can be introduced in the open spaces 15, thereby facilitating an increase in attachment between the fastening tape 10 and the foam. In one aspect, a width of the interrupted regions 31 of the longitudinal walls 30 in the longitudinal direction may be set to be equal to a width of the open spaces 15 in the longitudinal direction.

Figure 4:
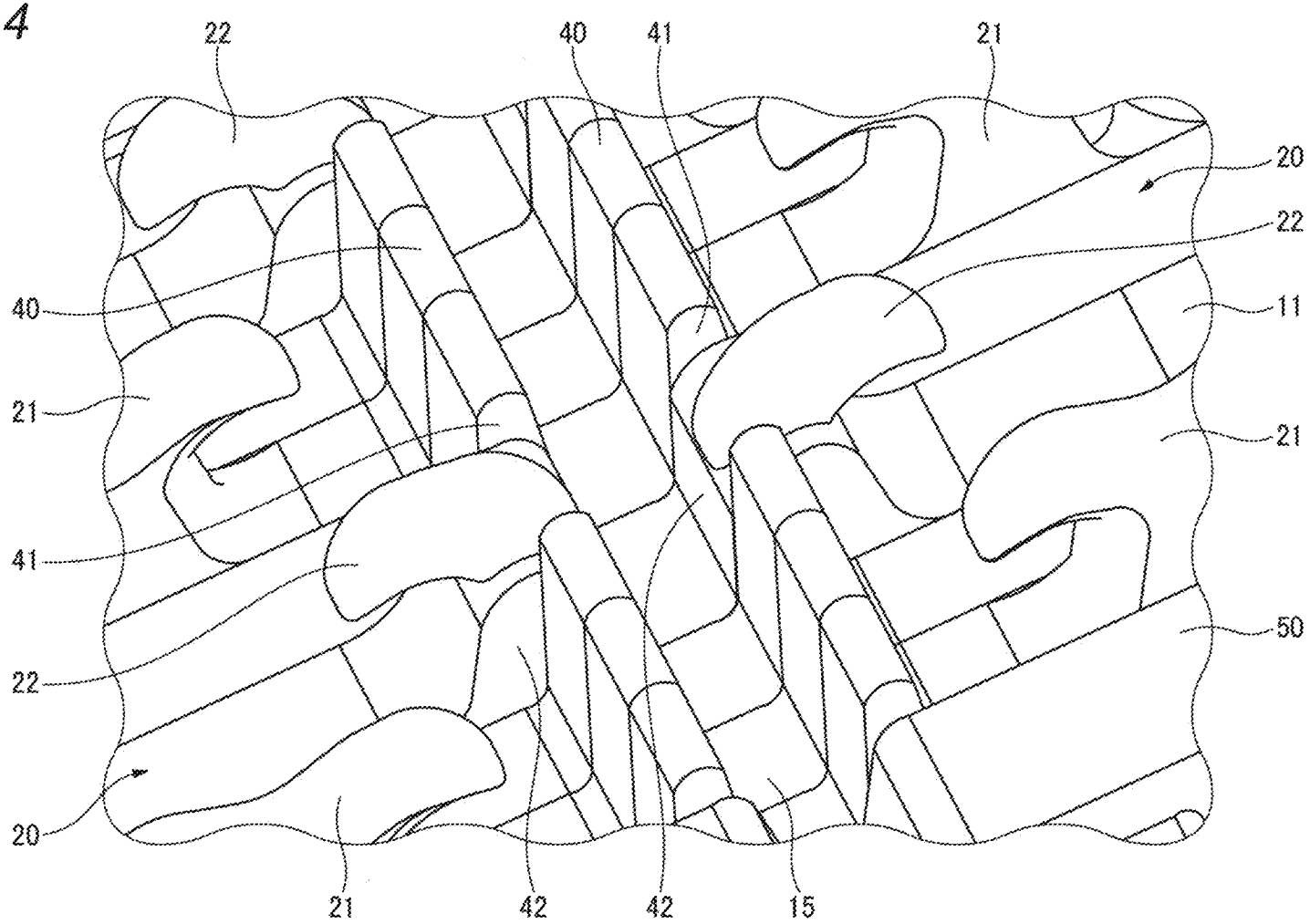
FIG. 4 is an enlarged perspective view of the vicinity of an open space shown in FIG. 3.

As shown in FIG. 4, each of the lateral walls 40 has slits 41 partially formed in an upper portion thereof. The slits 41 are provided with a half engaging element 22 having the same shape as that of a part of the engaging element 21. The half engaging element 22 extends inward of the fastening cell 20 in a direction away from the open space 15. In other words, an engaging portion of the half engaging element 22, which is capable of engaging with a loop fastener, extends inward of the fastening cell 20 in a direction away from the open space 15.

In addition, since the lateral walls 40 are provided with the slits 41, it is possible to improve flexibility of the fastening tape 10 to conform to rounded, curved or otherwise non-flat surfaces. Also, the half engaging elements 22 partially fill the respective slits 41, thereby preventing foam from intruding into the fastening cell 20 through the slits 41. Further, due to the half engaging elements 22, it is possible to avoid a decrease in engagement strength with the loop fastener, which would otherwise be caused by the open spaces 15.

Figure 5:
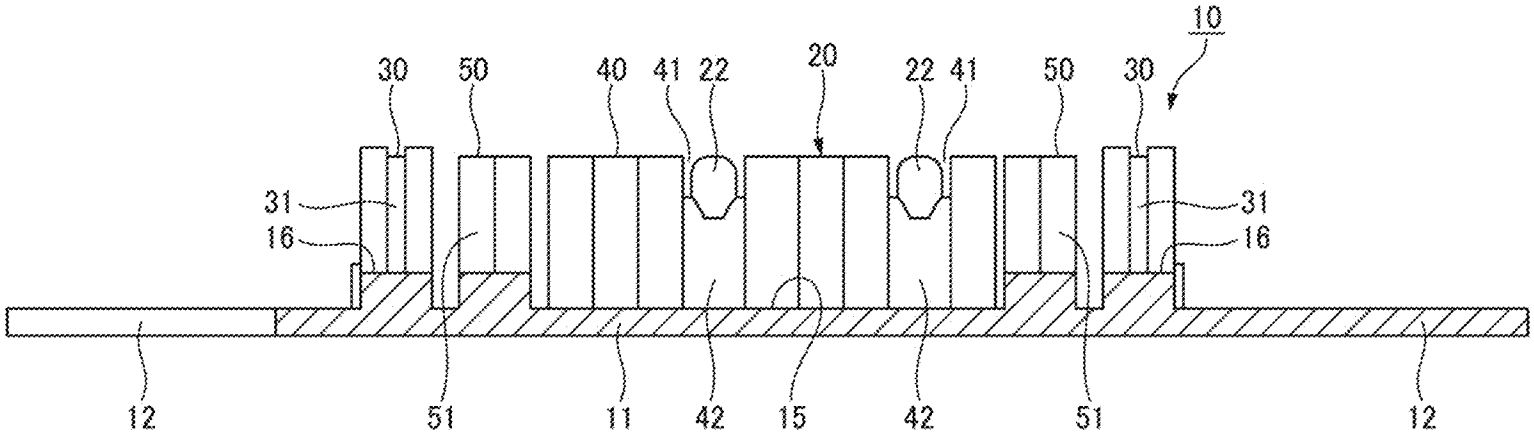
FIG. 5 is a sectional view taken along a line A-A in FIG. 2.

Also, as shown in FIG. 5, the lateral walls 40 have connection portions 42 filling a lower portion of the receptive slits 41.

Accordingly, the slits 41 don't continue to extend downward up to the substrate 11. Further, the half engaging elements 22 as described above is formed on an upper end of the respective connection portions 42.

In addition, since the lateral walls 40 have the connection portions 42, it is possible to prevent foam from intruding into the fastening cell 20 during the molding process for the cushion. Also, in the slits 41 above the connection portions 42, foam fills a part of the half engaging elements 22, thereby facilitating an increase in attachment between the fastening tape 10 and the foam. Further, since the lateral walls 40 have the connection portions 42, molten thermoplastic resin material R can be easily filled into cavities 92*a* of a die wheel 92, which are configured to mold the half engaging elements 22, during an injection molding process for manufacturing the fastening tape 10 (see FIG. 8).

Also, as shown in FIGS. 1 to 6, the fastening tape 10 of the present embodiment has a pair of intermittent magnetic walls 50 containing a magnetic material. The pair of magnetic walls 50 is formed along the longitudinal direction on the upper surface of the substrate 11 in such a way to be arranged adjacent to the pair of longitudinal walls 30, respectively, inward in the lateral direction from the pair of longitudinal walls 30. The magnetic walls 50 can attract the fastening tape 10 to a trench within a mold, thereby preventing foam from intruding into the fastening cells 20.

Each of the magnetic walls 50 has a plurality of breaks 51 formed at a predetermined interval in the longitudinal direction. Accordingly, the magnetic wall 50 is configured as an intermittent and linear arrangement. In addition, since the magnetic wall 50 is intermittently provided with the breaks 51, it is possible to improve flexibility of the fastening tape 10 in the longitudinal direction. The breaks 51 may be formed to extend up to the upper surface of the substrate 11 so that the magnetic wall 50 is absent therein, or may be formed to be shallow so that a part of the magnetic wall 50 is remained. Among the plurality of breaks 51 of the magnetic walls 50, a width of breaks 51 in the longitudinal direction, which are arranged to be aligned with the open spaces 15 (described below) in the lateral direction, is equal to a width of breaks 51 in the longitudinal direction, which are not arranged to be aligned with the open spaces 15 (i.e., breaks positioned within the fastening cells 20).

Figure 6:
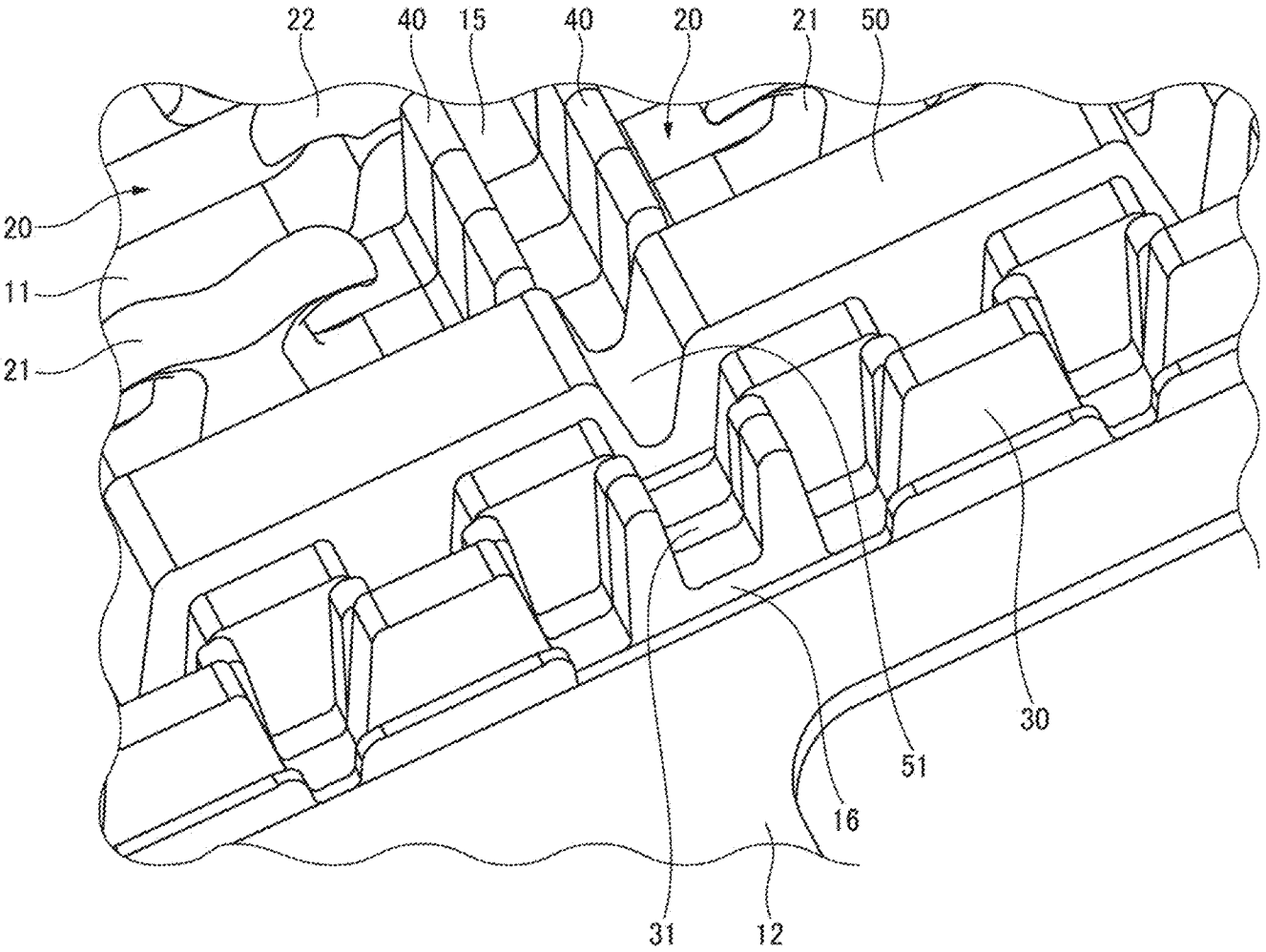
FIG. 6 is an enlarged perspective view of the vicinity of a longitudinal wall and a magnetic wall shown in FIG. 3.

Also, as shown in FIGS. 3 and 6, some of the plurality of breaks 51 of the magnetic walls 50 are arranged to be aligned with the open spaces 15 in the lateral direction, so that the open spaces 15 extend therethrough in the lateral direction. Accordingly, the open spaces 15, the interrupted regions 31 of the longitudinal walls 30 and some of the breaks 51 of the magnetic walls 50 are arranged to be aligned with each other in the lateral direction. Therefore, the breaks 51 of the magnetic walls 50 can become a part of the respective open spaces 15. In one aspect, a width of the breaks 51 of the magnetic walls 50 in the longitudinal direction may be set to be equal to the width of the open spaces 15 in the longitudinal direction. In the shown example, one open space 15, one interrupted region 31 on each of the right and left sides and one break 51 on each of the right and left sides are arranged to be aligned with each other in the lateral direction. Also, the width of the open spaces 15 in the longitudinal direction are preferably set to 0.5 mm to 1.5 mm. Further, a width of the fastening cells 20 in the longitudinal direction is preferably set to 10 mm or less. Preferably, the width of the open spaces 15 in the longitudinal direction is set to about 15% or less of the width of the fastening cells 20 in the longitudinal direction. In one example, the width of the fastening cells 20 in the longitudinal direction is about 9.7 mm, and the width of the open spaces 15 in the longitudinal direction is about 1.1 mm. Due to this numerical value setting, it is possible to securely attach the fastening tape 10 to a cushion body without decreasing the engagement strength with the loop member. Further, even if the fastening tape 10 is cut at any location in the longitudinal direction and then is used, it is possible to prevent a large amount of foam from intruding into the fastening cells 20 and thus to avoid a decrease in engagement strength.

As shown in FIG. 6, in the present embodiment, the width of the open space 15 in the longitudinal direction is set to be substantially equal to the widths of the interrupted regions 31 of the longitudinal walls 30 and the breaks 51 of the magnetic walls 50 in the longitudinal direction. In some cases, the width of the breaks 51 of the magnetic walls 50 in the longitudinal direction may be set to be wider at the top thereof than at the bottom as shown in FIG. 6. Therefore, it is possible to prevent the adjacent magnetic walls 50 from interfering with each other when the fastening tape 10 is bent to conform to a curved surface. In this case, the width of the open spaces 15 in the longitudinal direction is set to be substantially equal to the width at the top of the breaks 51 of the magnetic walls 50 in the longitudinal direction.

Also, as shown in FIG. 6, each of the open spaces 15 have protrusions 16 extending upward from the substrate 11. Preferably, the protrusions 16 are positioned nearer to side ends of the open space 15 than to the middle of the open space 15 in the lateral direction. Although in the embodiment shown in FIG. 6, the protrusions 16 are positioned at positions of the interrupted regions 31 of the longitudinal walls 30, the present disclosure is not limited thereto. The protrusions 16 may be positioned at positions of the breaks 51 of the magnetic walls 50 or may be positioned at both of positions of the interrupted regions 31 of the longitudinal walls 30 and positions of the breaks 51 of the magnetic walls 50. Further, a height of the protrusions 16 is smaller than a height of the longitudinal walls 30 or the magnetic walls 50. Therefore, the protrusions 16 don't significantly impede introduction of foam into the open space 15.

Figure 8:
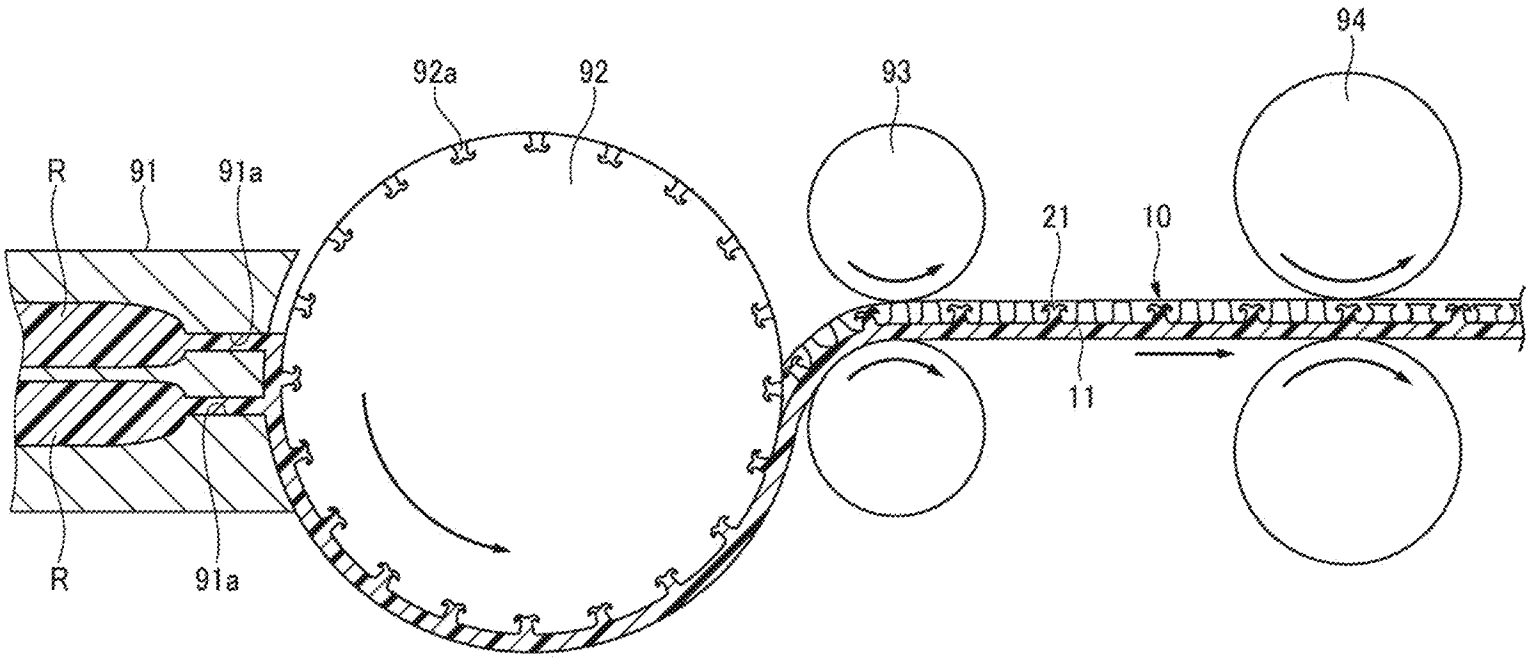
FIG. 8 is a schematic diagram explaining an injection molding process for manufacturing the fastening tape.

In addition, since the protrusions 16 are provided, it is possible to prevent the fastening tape 10 from becoming too flexible at the open spaces 15, thereby preventing breakage of the fastening tape 10 when being bent. In contrast, if the fastening tape 10 is too flexible at the open spaces 15, flexibility thereof in the longitudinal direction is likely to be inconsistent. Therefore, when a trench has a curved surface, an undesirable gap between the fastening tape and the trench is likely to be caused. Further, when the fastening tape 10 is peeled from the die wheel 92 during the injection molding process for manufacturing the fastening tape 10 as shown in FIG. 8, the protrusions 16 can prevent the fastening tape 10 from breaking away.

Further, since the protrusions 16 are positioned near to the side ends of the open spaces 15 in the lateral direction, it is possible to regulate an amount of foam introduced into the open spaces 15 as necessary. That is, it is possible to prevent an excessive amount of foam from being introduced into the open spaces 15 and thus intruding into the fastening cells 20 beyond the lateral walls 40.

Figure 7:
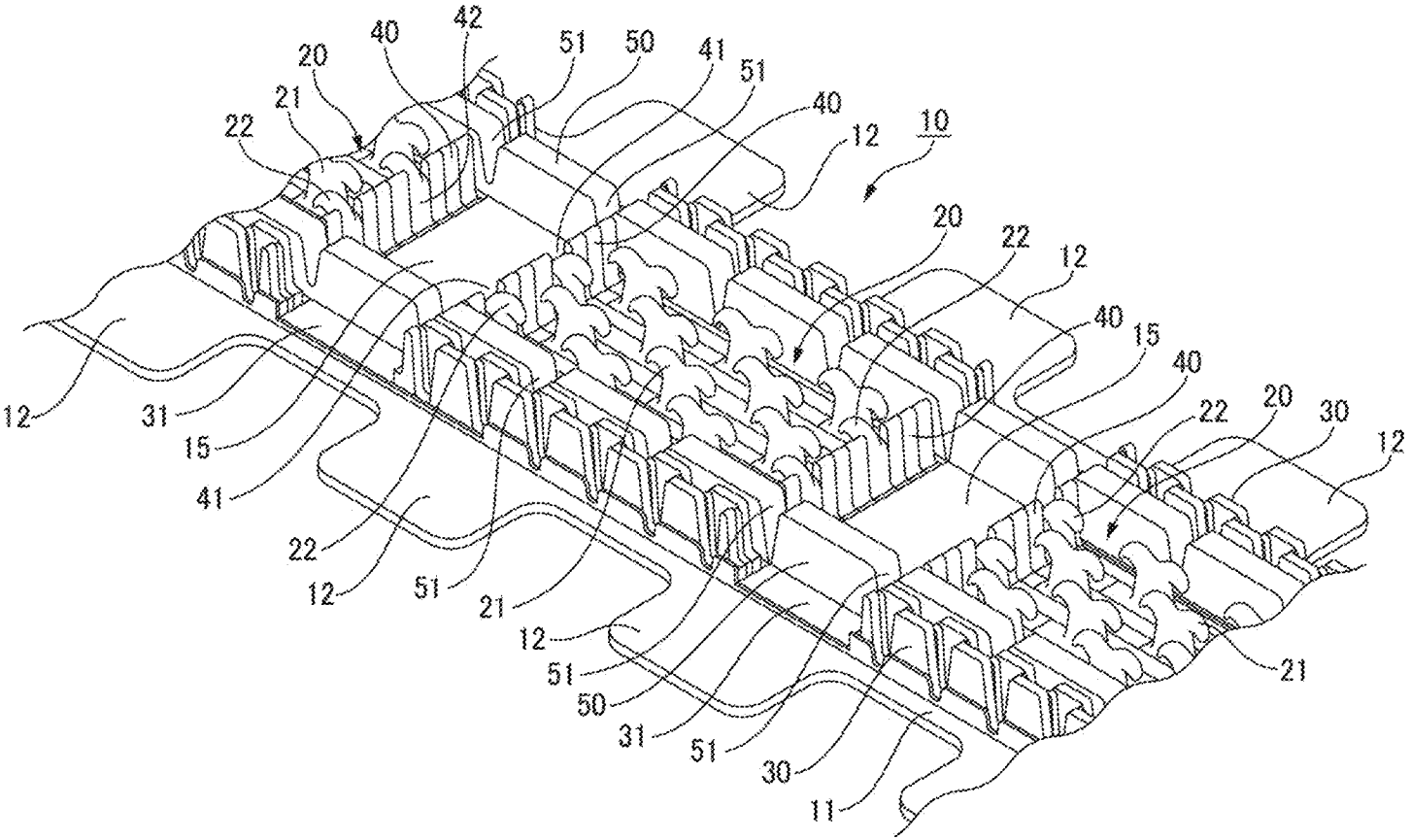
FIG. 7 is a top perspective view showing a first variant of the fastening tape according to the first embodiment.

Also, as one variant of the present embodiment, the width of the open space 15 between the fastening cells 20 in the longitudinal direction may be set to be larger as shown in FIG. 7. In this case, the open space 15 may have a part of the magnetic walls 50. However, the breaks 51 of the magnetic walls 50 are preferably positioned to overlap with the open space 15 in the lateral direction, thereby enabling foam to be introduced into the open space 15. Therefore, the breaks 51 of the magnetic walls 50 can become a part of the open space 15. In the embodiment shown in FIG. 7, the open space 15 has two magnetic walls 50 and four breaks 51 on both sides thereof in the lateral direction. In other words, the open space 15 is formed to extend in the lateral direction through four breaks 51.

Next, the injection molding process for manufacturing the fastening tape 10 will be described. As shown in FIG. 8, the fastening tape 10 is molded by injecting molten thermoplastic resin material R into the die wheel 92 using the injection device 91. The injection device 91 feeds the molten thermoplastic resin material R toward an outer circumferential surface of the rotating die wheel 92 through two channels 91*a*. At this time, the molten thermoplastic resin material R is filled into the cavities 92 formed in the outer circumferential surface of the die wheel 92 for molding the engaging elements 21 and the like. Then, after injection molding, the fastening tape 10 is conveyed to the next manufacturing step by feed rollers 93, 94. Also, as the fastening tape 10 is conveyed by the feed rollers 93, 94, the fastening tape 10 is peeled from the die wheel 92.

Second Embodiment

Figure 10:
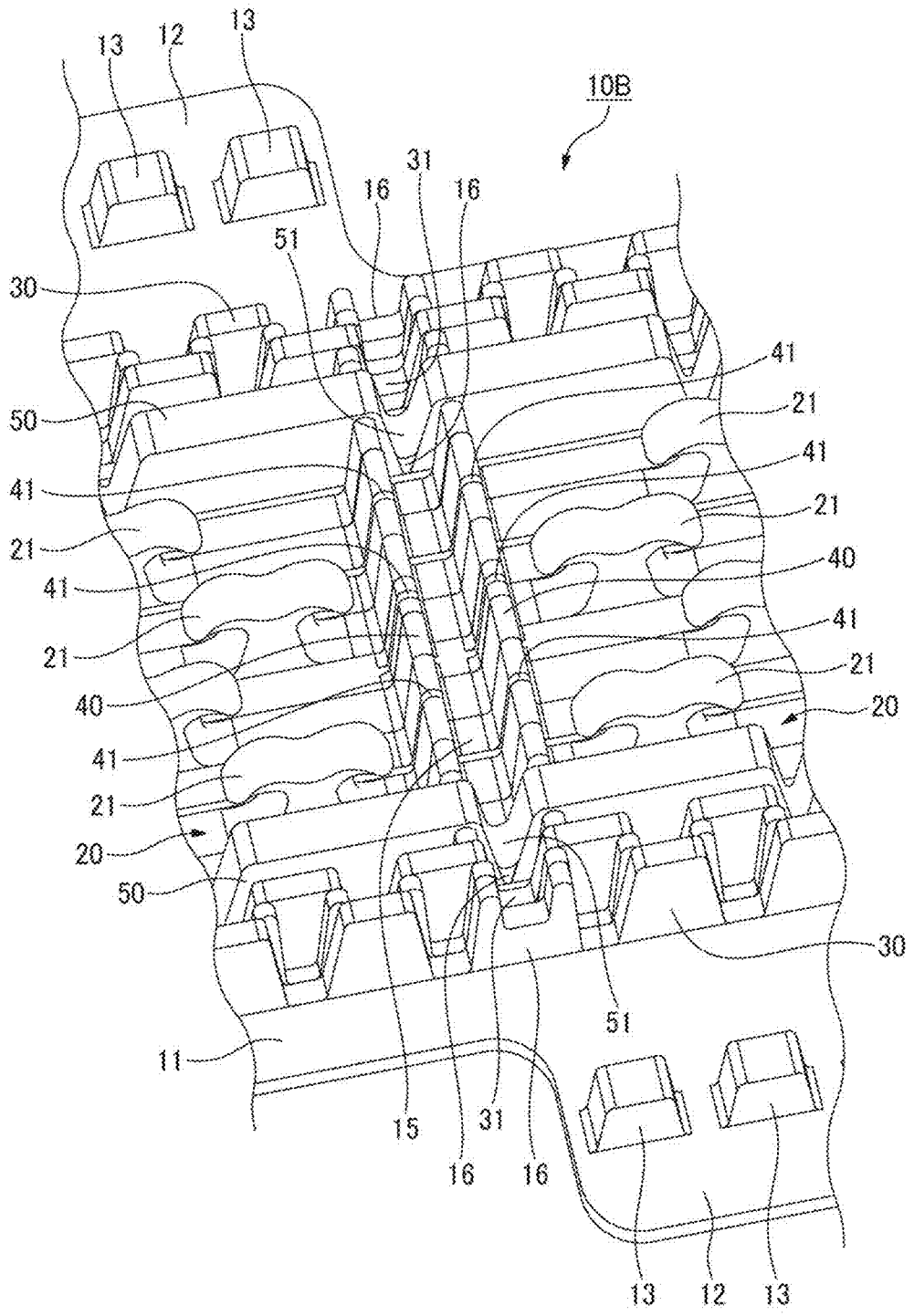
FIG. 10 is a top perspective view showing a first variant of the fastening tape according to the second embodiment.
Figure 11:
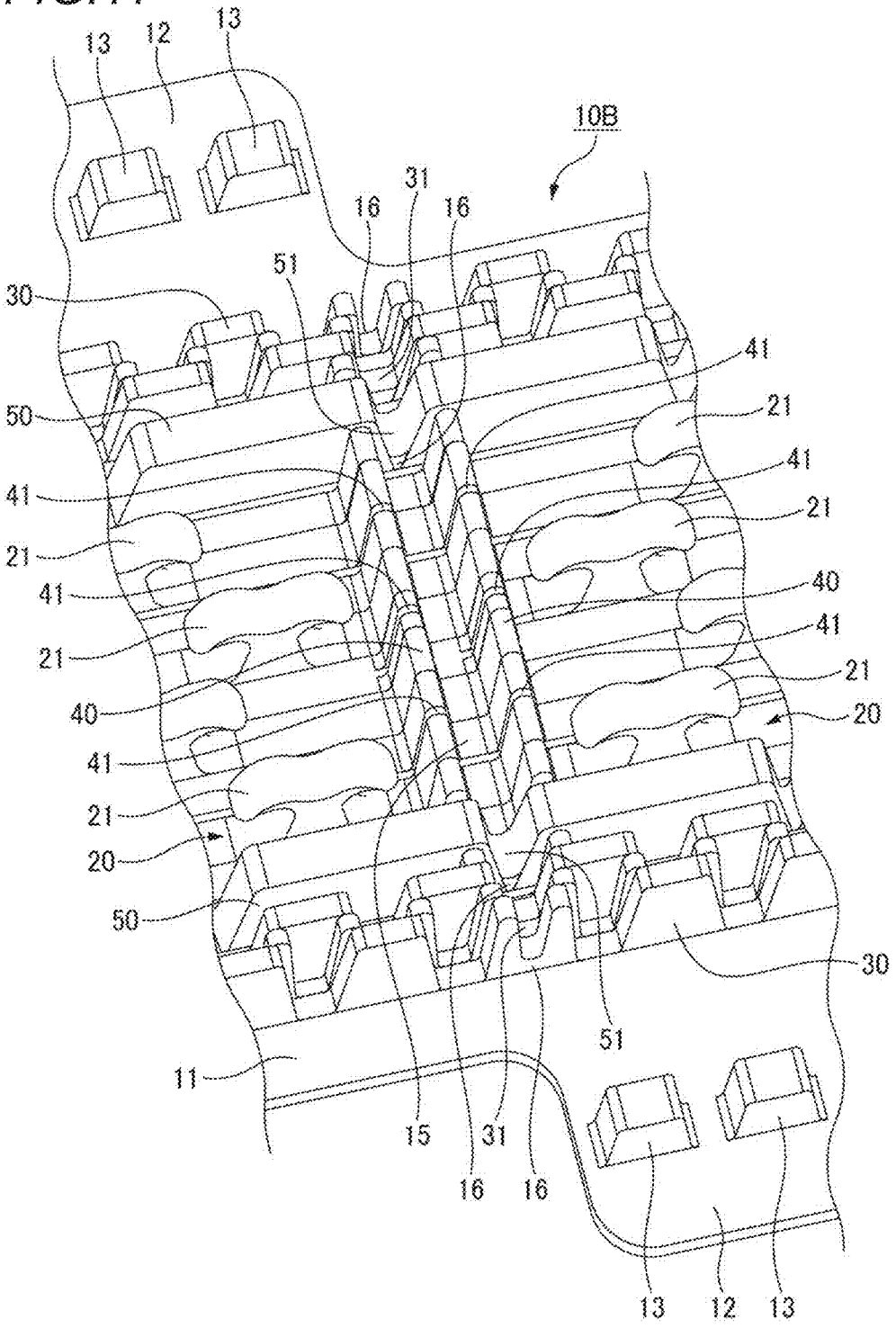
FIG. 11 is a top perspective view showing a second variant of the fastening tape according to the second embodiment.

Next, a second embodiment of a fastening tape according to the present disclosure will be described with reference to FIGS. 9 to 11. Meanwhile, the same portions as those of the first embodiment as described above are designated by the same reference numerals in the figures, and accordingly, the descriptions thereof will be omitted or simplified.

Figure 9:
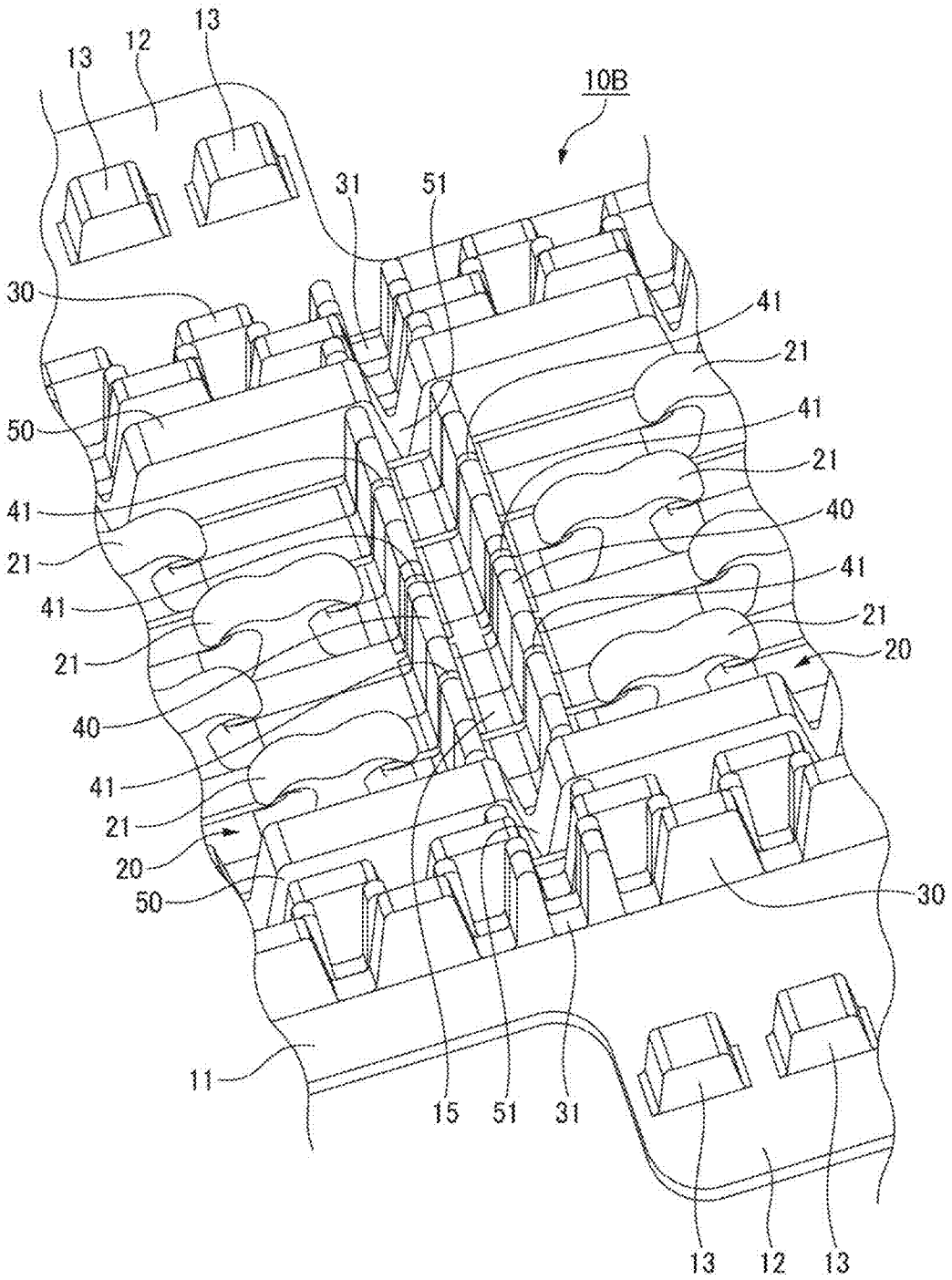
FIG. 9 is a top perspective view showing a second embodiment of a fastening tape according to the present disclosure.

In a fastening tape 10B according to the present embodiment, no half engaging element 22 and connection portion 42 are provided in slits 41 of lateral walls 40 as shown in FIG. 9. Also, interrupted regions 31 of longitudinal walls 30 and breaks 51 of magnetic walls 50 are formed to extend up to the upper surface of the substrate 11. Further, no protrusion 16 is provided on interrupted regions 31 of the longitudinal walls 30. Further, on an upper surface of each of flanges 12 of the substrate 11, protrusions 13 having a generally trapezoidal shape and extending upward are formed at a predetermined interval in the longitudinal direction. Thus, since the protrusions 13 are formed on the flanges 12, it is possible to facilitate an increase in attachment between the fastening tape 10B and foam.

Also, a first variant of the present embodiment will be described with reference to FIG. 10. In the present variant, protrusions 16 are provided at both of positions of the interrupted regions 31 of the longitudinal walls 30 and positions of breaks 51 of the magnetic walls 50. According to the present variant, it is possible to regulate an amount of foam introduced into the open spaces 15 as necessary. That is, it is possible to prevent an excessive amount of foam from being introduced into the open spaces 15 and thus intruding into the fastening cells 20 beyond the lateral walls 40.

Further, a second variant of the present embodiment will be described with reference to FIG. 11. In the present variant, a width of the interrupted regions 31 of the longitudinal walls 30 in the longitudinal direction is set to be smaller than a width of the open spaces 15 and the breaks 51 of the magnetic walls 50 in the longitudinal direction. According to the present variant, it is possible to regulate an amount of foam introduced into the open spaces 15 as necessary. That is, it is possible to prevent an excessive amount of foam from being introduced into the open spaces 15 and thus intruding into the fastening cells 20 beyond the lateral walls 40.

The other configurations and effects are similar to the foregoing embodiments.

Meanwhile, the present disclosure is not limited to the foregoing embodiments, but may be appropriately modified without departing from the spirit and scope of the present disclosure.

For example, at least one of a lateral gap between the longitudinal wall 30 and the magnetic wall 50 and a lateral gap between the lateral wall 40 and the magnetic wall 50 may be provided with a block member for filling the gap. Therefore, it is possible to further prevent foam from intruding into the fastening cells 20 during the molding process for the cushion.

In addition, a lateral wall 40 may be further provided inside the fastening cells 20. For example, the lateral wall 40 may be further provided at the middle, in the longitudinal direction, of the fastening cells 20. Also, the lateral wall 40 may be provided near to each of both ends, in the longitudinal direction, of the fastening cells 20, thereby doubly providing the lateral walls 40.

Like components and steps not shown or described, various arrangements of the components depicted in the figures or described above are possible. Similarly, some of features and sub-combinations thereof may be useful and may be employed independent of other features and sub-combinations. The embodiments of the disclosure have been described for purposes of illustration and not limitation, and alternative embodiments thereof will become apparent to readers of this specification. Accordingly, the present invention is not limited to the embodiments described above or depicted in the figures, and various embodiments and modifications can be made.

What is claimed is:

1. A fastening tape, comprising:

an elongated substrate;

a plurality of fastening cells on a surface of the substrate; and a magnetic material in at least one linear arrangement along a longitudinal direction of the substrate, wherein each of at least some of the fastening cells comprises:

a fastening element array; and one or more barriers at least partially surrounding the fastening element array;

wherein the magnetic material has a plurality of breaks formed at a predetermined interval in the longitudinal direction, wherein at least some of the fastening cells which are adjacent to each other in the longitudinal direction are separated from each other by an open space extending across the substrate in a lateral direction, wherein at least some of the plurality of breaks of the magnetic material are arranged to be aligned with the open spaces in the lateral direction, wherein a width of the open spaces in the longitudinal direction is set to be equal to a width of the at least some of the plurality of breaks of the magnetic material in the longitudinal direction.

2. The fastening tape according to claim 1, wherein the one or more barriers are a pair of longitudinal walls extending in the longitudinal direction and a pair of lateral walls extending in the lateral direction between the pair of longitudinal walls, wherein each of the pair of longitudinal walls has a plurality of interrupted regions formed at a predetermined interval in the longitudinal direction, and wherein the interrupted regions of the longitudinal walls are arranged to be aligned with the open spaces in the lateral direction.

3. The fastening tape according to claim 2, wherein the magnetic material is a pair of magnetic walls arranged adjacent to the pair of longitudinal walls, respectively, inward in the lateral direction from the pair of longitudinal walls.

4. The fastening tape according to claim 2, wherein at least one of the magnetic material and the longitudinal walls has a protrusion.

5. The fastening tape according to claim 3, wherein a width of the interrupted regions of the longitudinal walls in the longitudinal direction is set to be smaller than a width of the breaks of the magnetic material in the longitudinal direction.

6. The fastening tape according to claim 1, wherein each of the at least some of the fastening cells further comprises:

at least one slit provided in an upper portion of at least one of the one or more barriers; and a fastening element at least partially filling the slit, and wherein the fastening element at least partially filing the slit extends inward of the respective fastening cells in a direction away from a respective one of the open spaces.

7. The fastening tape according to claim 6, wherein the one or more barriers are a pair of longitudinal walls extending in the longitudinal direction and a pair of lateral walls extending in the lateral direction between the pair of longitudinal walls, and wherein the at least one slit is provided in an upper portion of the pair of lateral walls.

* * * * *